US012044079B1

(12) United States Patent
Medina et al.

(10) Patent No.: US 12,044,079 B1
(45) Date of Patent: Jul. 23, 2024

(54) TRAVEL JOINT WITH TELESCOPING CONTROL LINES

(71) Applicant: Halliburton Energy Services, Inc., Houston, TX (US)

(72) Inventors: Jorge Arturo Hinostroza Medina, Rio de Janeiro (BR); Desiderio Naegele Rodrigues Junior, Rio de Janeiro (BR)

(73) Assignee: Halliburton Energy Services, Inc., Houston, TX (US)

( * ) Notice: Subject to any disclaimer, the term of this patent is extended or adjusted under 35 U.S.C. 154(b) by 27 days.

(21) Appl. No.: 18/090,624

(22) Filed: Dec. 29, 2022

(51) Int. Cl.
*E21B 17/07* (2006.01)
*E21B 23/00* (2006.01)

(52) U.S. Cl.
CPC ..... *E21B 17/07* (2013.01); *E21B 23/00* (2013.01)

(58) Field of Classification Search
CPC ..... E21B 17/07; E21B 23/00; E21B 17/02; E21B 17/026
See application file for complete search history.

(56) References Cited

U.S. PATENT DOCUMENTS 6,349,770 B1 2/2002 Brooks
8,915,304 B2 * 12/2014 Richards ..... E21B 17/1035 285/302
10,422,191 B2 * 9/2019 Richards ..... E21B 17/07
11,319,759 B1 5/2022 Mahendran et al.
2010/0224375 A1 9/2010 Du et al.
2012/0186826 A1 7/2012 Le Briere et al.
2013/0025880 A1 * 1/2013 Richards ..... E21B 17/07 166/85.1
2015/0204145 A1 7/2015 Richards et al.
2015/0330157 A1 11/2015 Roane et al.
2016/0258229 A1 9/2016 Delzell et al.
2016/0290063 A1 * 10/2016 Richards ..... E21B 17/0283
2017/0183918 A1 * 6/2017 Grattan ..... E21B 17/07
2017/0328141 A1 * 11/2017 Richards ..... E21B 33/04
2019/0257159 A1 8/2019 Dietz

FOREIGN PATENT DOCUMENTS

WO 2016099560 6/2016
WO WO-2022260531 A1 * 12/2022

OTHER PUBLICATIONS

International Search Report and Written Opinion for International Patent Application No. PCT/US2023/012191 dated Sep. 15, 2023.

* cited by examiner

*Primary Examiner* — Daniel P Stephenson
(74) *Attorney, Agent, or Firm* — Scott Richardson; C. Tumey Law Group PLLC

(57) ABSTRACT

A travel joint may accommodate relative movement between an upper and lower completion for communication of well fluids and control signals, while protecting the control lines used for signal control In one example, the travel joint has an upper tubular member telescopically coupled to the lower tubular member to collectively define a flow path for well fluids through the travel joint. A plurality of telescoping control line conduits are secured about a travel joint periphery, each including an outer tube telescopically coupled to an inner tube to accommodate relative movement between the upper and lower tubular members. A control line routed through each telescoping control line conduit. A dynamic or expanding/hardening seal interface may be provided in the control line conduit to protect the control lines routed therethrough.

20 Claims, 6 Drawing Sheets

TRAVEL JOINT WITH TELESCOPING CONTROL LINES

BACKGROUND

Drilling rigs supported by floating drill ships or floating platforms can be used for offshore wellbore creation and production. A travel joint, sometimes referred to as a slip joint, is a component used in oil and gas industry to accommodate tubing movement or length changes while connected to a production conduit. A travel joint is sometimes used to connect to a lower completion, for example, such as for installing a tubing hanger inside a wellhead after installing the production tubing string. For performing subterranean operations, control lines may be used to provide a path for power and/or data communication to various flow control devices and/or gauges attached to the production tubing string or the completion equipment downhole.

Control lines conventionally require excess length to accommodate length changes in the travel joint, which excess length must be managed. In at least some prior solutions, the control lines are arranged along the outside of the production tubing string, and the excess length is managed by arranging the control lines in a helical coil about the tubing string. However, the control lines may still be subject to wear or damage. For example, the axial movements of the travel joint may impart stresses to the control lines and other challenges related to movement of control lines along the travel joint.

BRIEF DESCRIPTION OF THE DRAWINGS

These drawings illustrate certain aspects of some of the embodiments of the present disclosure and should not be used to limit or define the method.

DETAILED DESCRIPTION

The present disclosure addresses challenges encountered in establishing fluid and signal communication in a completion system. A travel joint is presented that may telescope tubing after landing the upper completion in the lower completion, such as to set a tubing hanger. This presents challenges, especially in smart wells, having control lines to control downhole equipment (e.g., downhole gauges, choke valves, and chemical injection systems). Aspects of this disclosure allow the upper completion tubing to telescope while maintaining hydraulic and electrical communication with equipment further downhole.

In an example embodiment, a control line travel joint (CLTJ) includes telescoping control line conduits. Each control line conduit includes a set of telescoping tubes (i.e., telescoping tube set) for housing and protecting electrical, optical, and/or hydraulic control lines. Each telescoping tube set may be comprised of an inner and an outer tube with a seal arranged therebetween. When the travel joint is landed and starts telescoping, the telescoping tubes will telescope at the same time. The tube set includes a seal interface, such as to protect the control lines and prevent ingress of contaminants. The seal interface may also prevent egress of hydraulic control fluid used in a hydraulic control line or an insulating fluid used with electrical control lines. The seal may be a dynamic seal that maintains sealing during telescoping. Alternatively, a swellable element (e.g., swellable metallic material) may be provided over the telescoping seals to lock the lines in position after installing the tubing hanger. The stability of the outer telescopic tube is also increased by providing the support on the OD of the outer mandrel and added sliding guides to support the hanging control lines on the inner telescopic tube of the CLTJ. In this solution, the stroke length and number of tubes can be managed easily.

The control lines may include electric cables, hydraulic cables, fiber optic cables, or a combination thereof. For instance, electric and/or hydraulic cables may provide power to various flow control devices downhole to control the rate of production flow into the production tubing string. Similarly, electric and/or fiber optic cables may transmit data from one or more sensors downhole relating to reservoir and fluid properties such as, for example, pressure, temperature, density, flow rate, fluid composition, and/or water content.

Figure 1:
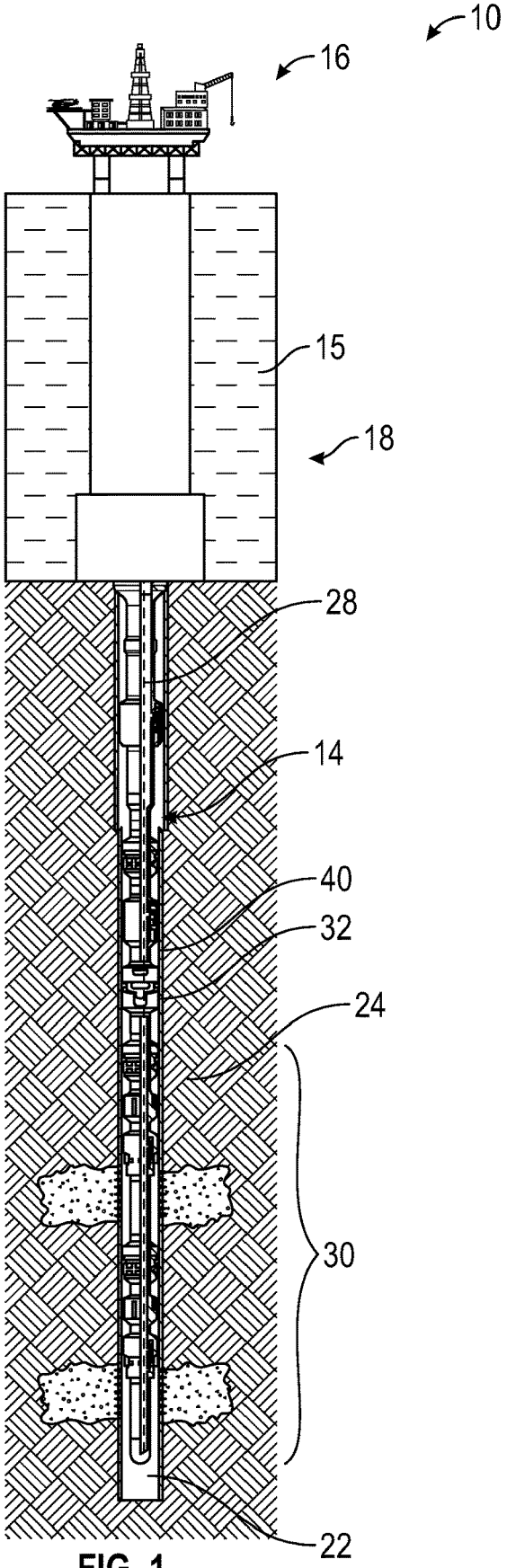
FIG. 1 is an elevation view of an example of a subsea well system in which aspects of the disclosure may be implemented.

FIG. 1 is an elevation view of an example of a subsea well system 10 in which aspects of the disclosure may be implemented. A rig 16 is provided at a well site for extracting hydrocarbons such as oil and gas using the well system 10. The well system 10 is depicted in this example as having an offshore platform, such as a drill ship or jack up rig, but could alternatively use a land-based drilling rig. The subsea well system 10 includes an upper completion assembly (i.e., upper completion) 14 secured to a lower completion assembly (i.e., lower completion) 30 for recovering well fluids form the wellbore 22 to the rig 16. Generally, the lower completion 30 comprises various equipment permanently installed in the well 22 that connects the oil and gas formation with the wellbore. The upper completion 14 provides a link between the rig 16 and the lower completion 30 and is generally retrievable. The upper completion 14 may comprise a long tubing string lowered from the rig 16 through a riser 15 and releasably connected to the lower completion 30 using a disconnect tool 32, such as an electro-hydraulic disconnect tool (EHDT).

The lower completion 30 can be installed in a completion process that prepares the wellbore 22 for production or injection operations. Examples of elements that can be in the lower completion 30 include packers, well screens, perforated liner or casing, production or injection valves, flow control devices, and chokes. The upper completion 14 can be sealingly received in a packer 24 at an upper end of the lower completion 30, so that well fluids may be produced. For example, the upper completion 14 can have a seal stack that seals within a sealed bore receptacle. The upper completion 14 may also have flow control devices, valves, and other components, to control or regulate the flow of reservoir fluids into the upper completion 13. The upper completion 14 may also include various control lines to provide power and communication to the components of the lower completion 30.

A travel joint 40 is provided at the lower end of the upper completion 14 to accommodate axial movement after initially securing the upper completion 14 to the lower completion 30. The travel joint 40 may be an electro-hydraulic travel joint (EHTJ) further detailed below and in subsequent figures. For example, the upper completion 14 may be lowered toward the lower completion 30 to allow a tubular component of the upper completion to be sealingly engaged with a tubular component of the lower completion. The travel joint 40 accommodates such relative movement while allowing fluid communication of well fluids and signals through the travel joint 40 between the upper and lower completions 14, 30. The travel joint 40 may include telescoping upper and lower tubular members that are in-line with the tubing string and defining a flow path for well fluids. The travel joint 40 may also include telescoping control line conduits arranged around the periphery, as further explained below and illustrated in subsequent figures. For example, one or more signal communication pathways schematically indicated at 28 may be cooperatively defining by respective control lines extends from the rig 16 along (e.g., external to) the upper completion 14, through the travel joint 40, and to one or more components of the lower completion 30. The control line(s) can provide power, data communication, control, or a combination between a surface and elements of the lower completion 30, components on the upper completion 14, or otherwise other components in the wellbore 22.

Figure 2:
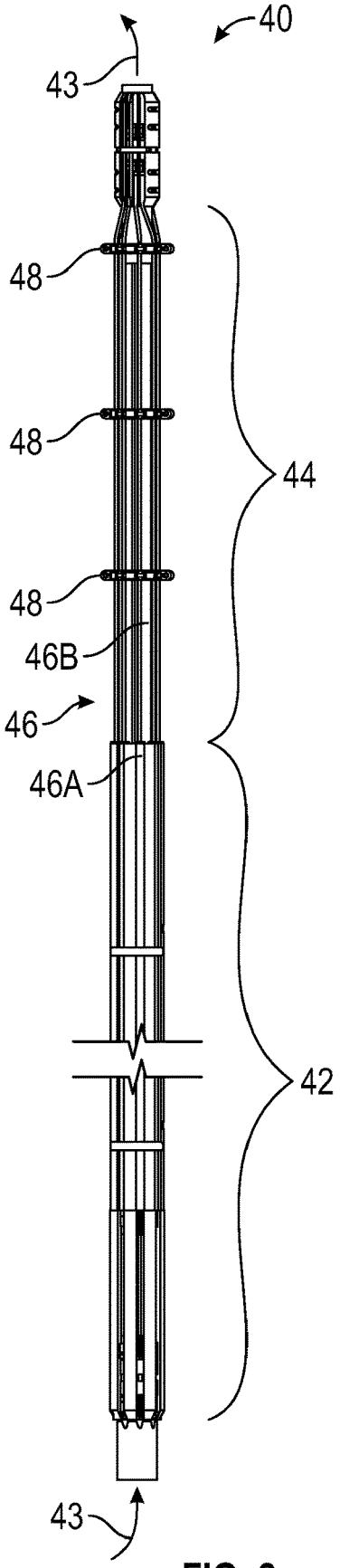
FIG. 2 is a side view of the travel joint according to an example configuration while in an extended position.

FIG. 2 is a side view of the travel joint 40 according to an example configuration while in an extended position. The travel joint 40 includes a lower tubular member 42 and an upper tubular member 44 telescopically coupled to the lower tubular member 42 to collectively define a flow path 43 for well fluids through the travel joint 40. A plurality of telescoping control line conduits generally indicated at 46 are secured about a periphery of the travel joint 40. Each telescoping control line conduit 46 comprises a telescoping tube set that includes an outer tube 46A telescopically coupled to an inner tube 46B to accommodate relative movement between the upper tubular member 44 and lower tubular members 42.

A plurality of control line supports 48 are provided for securing the control line conduits 46 in a circumferentially spaced arrangement about a periphery of the travel joint 40. The control line supports are specifically coupled to the upper tubular member 44 in this example, and used to support the upper/inner tubes 46B. However, an alternative configuration could use similar control line supports to support the lower/outer tubes 46A. The control line supports 48 comprises collars that are axially spaced along the travel joint 40 at least in the extended position of FIG. 2. The inner tubes 46B may be slidingly received by the control line supports 48 so as to accommodate retraction of the upper tubular member 44 of the travel joint 40 into the lower tubular member 42.

The telescoping control line conduits 46 house and protect various control lines used to communicate control signals through the travel joint 40. The control lines may include one or more electrical control lines for communicating electrical signals to one or more downhole components, optical control lines for communicating optical signals to the one or more downhole components, and/or a hydraulic control lines for communicating hydraulic pressure for hydraulically actuating the one or more downhole components. In one configuration, the control line conduits 46 may be relatively narrow to accommodate one control line per control line conduit 46. However, it may be possible to size the control line conduits 46 to accommodate more than one control line per control line conduit 46.

The travel joint 40 allows for the simultaneous communication of well fluids via the telescoping lower and upper tubular members 42, 44 and communication of control signals via the telescoping control line conduits 46. The conduits 46 are external to the flow path 43 so as to not interfere with the flow of well fluids through the travel joint 40. The lower/upper tubular members 42, 44 define a variable length flow path 43 by virtue of their telescopic arrangement. The telescopic arrangement of the tubular members 42, 44 and telescoping tube sets 46A, 46B thus allows for communication of well fluids and control signals, while accommodating relative movement between the upper and lower completions of FIG. 1.

Figure 3:
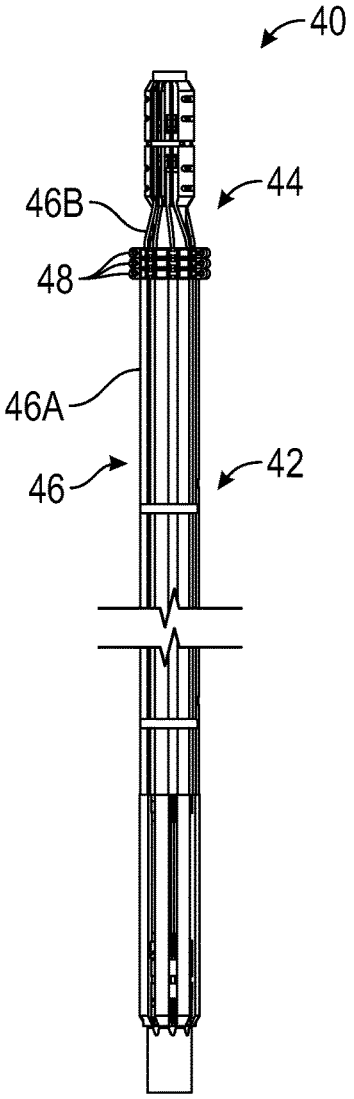
FIG. 3 is a side view of the travel joint having been moved from the extended position of FIG. 2 to a retracted position.

FIG. 3 is a side view of the travel joint 40 having been moved from the extended position of FIG. 2 to a retracted position. The upper tubular member 44 has been telescopically retracted with respect to the lower tubular member 42 of the travel joint 40. For example, in use, a lower end of the travel joint 40 may be landed and secured to the lower completion and the upper completion (see FIG. 1) further lowered. The travel joint 40 accommodates this relative movement between the upper and lower completion by retracting (e.g., by sliding) the upper tubular member 44 into the lower tubular member 42 of the travel joint 40. The telescoping control line conduits 46 accommodate this relative movement between upper and lower tubular members 44, 42 by telescoping, such as by sliding the upper/inner tube 46B into the lower/outer tube 46A.

The sliding relationship between the inner tubes 46B with the control line supports 48 accommodates this movement from the extended position of FIG. 2 to the retracted position of FIG. 3. In particular, the control line support 48 have been moved axially towards one another, from an axially spaced arrangement of FIG. 2 to an abutting arrangement, to occupy a minimal amount of axial length along the travel joint 40.

Figure 4:
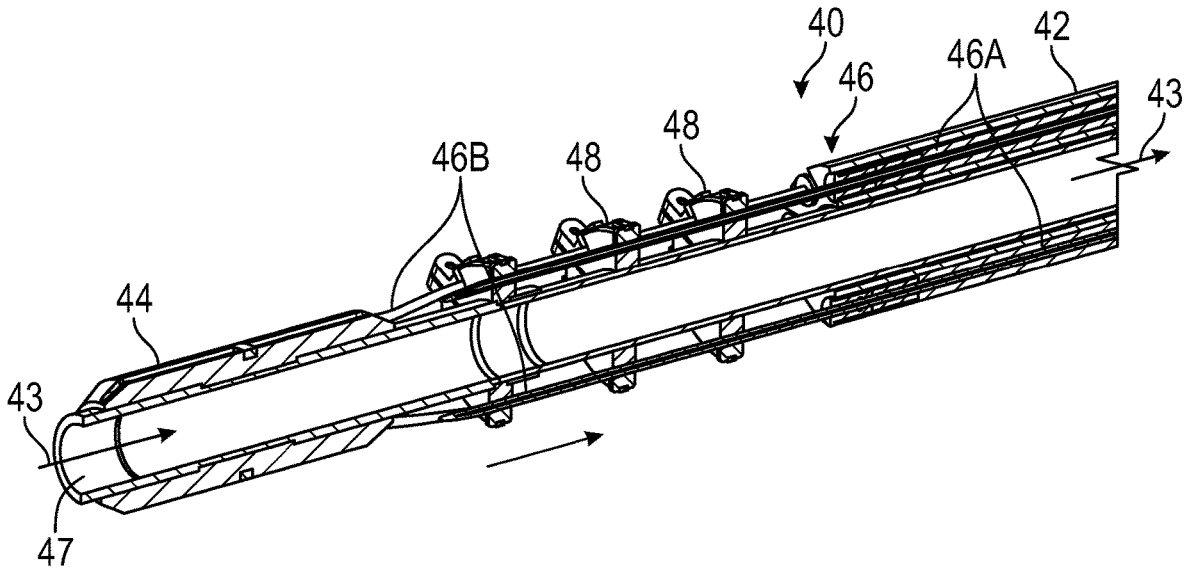
FIG. 4 is a perspective view of the travel joint further illustrating an arrangement of the telescoping control line conduits.

FIG. 4 is a perspective view of the travel joint 40 further illustrating an arrangement of the telescoping control line conduits 46. It can be seen, for example, that the inner tubes 46B are routed from an upper end 47 of the upper tubular member 44 of the travel joint 40, through the axially spaced control line supports 48, and into the inner tubes 46A of the telescoping control line conduits 46. As the upper tubular member 44 is retracted into the lower tubular member 42, the inner tubes 46B may slide within the outer tubes 46A and within the control line supports 48. The flow path 43 for well fluids is defined by an interior of the upper and lower tubular members 44, 42. The flow path 43 is maintained while its length varies as the upper tubular member 44 extends or retracts telescopically with respect to the lower tubular member 42. The flow path 43 is also in parallel with but without interference by the control line conduits 46.

Figure 5:
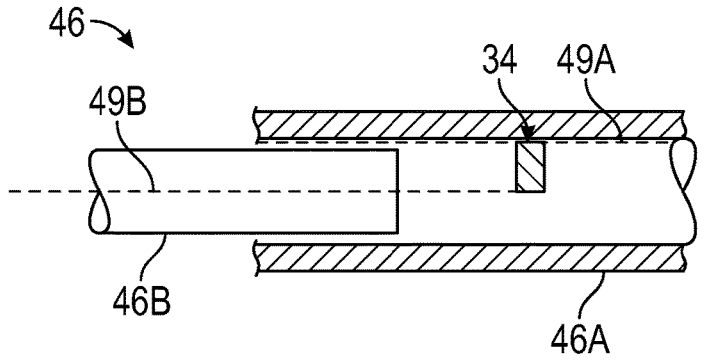
FIG. 5 is a schematic view of an electrical signal transmission path with a sliding electrical contact for accommodating relative movement between the outer tube and inner tube.

FIG. 5 is a schematic view of an electrical signal transmission path with a sliding electrical contact 34 for accommodating relative movement between the outer tube 46A and inner tube 46B. The signal transmission path may comprise a first segment 49A along or through the outer tube 46A and a second segment 49B along or through the inner tube 46B. The sliding electrical contact 34 allows the two segments 49A, 49B to remain in electrical contact during relative movement between the outer tube 46A and inner tube 46B.

Figure 6:
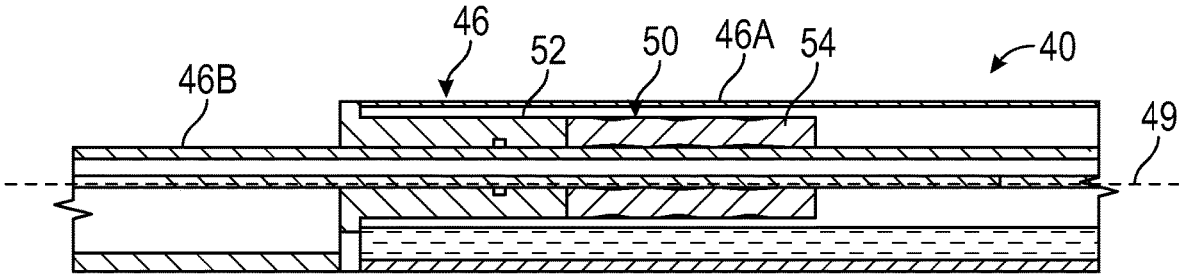
FIG. 6 is a sectional side view of the travel joint including an example of an expandable seal interface between the inner tube and outer tube of a control line conduit.

FIG. 6 is a sectional side view of the travel joint 40 including an example of an expandable seal interface 50 between the inner tube 46B and outer tube 46A of one of the control line conduits 46. The control line conduit 46 defines an interior space, e.g., an inner diameter (ID), for at least one control line 49, that the control line conduit 46 is designed to house and protect. The seal interface 50 may include a seal 52 disposed between the inner tube 46B and the outer tube 46A. In this example, the seal 52 is disposed between an exterior surface, e.g., an outer diameter (OD) of the inner tube 46B and an interior surface, e.g., an inner diameter (ID) of the outer tube 46A. This seal 52 may at least initially allows relative (sliding) movement between the inner tube 46B and the outer tube 46A, while preventing or minimizing intrusion of fluids and contaminants into the control line conduit 46 or the escape of any fluids intended to be captured inside the control line conduit 46.

A swellable element 54 is also included with the seal 52 in this example. The seal 52 and swellable element 54 are schematically separated but could be combined if desired into an expandable sealing element rather than as distinct and separate elements. The swellable element 54 comprises a swellable material that swells in response to exposure to an activation fluid. This swellable element may be activated, for example, after securing the lower tubular member to the lower completion, such as after retracting the travel joint 40. The swellable element 54 in some embodiments at least helps reinforce the sealing action of the seal 52. In other examples, the swellable element 54 hardens and the seal interface 50 becomes non-dynamic. This may be useful, for example, after the travel joint has been fully retracted and no further relative movement is desired.

In some embodiments, an elastomer-based swellable materials (i.e., a swellable elastomer) could be used that swells to reinforce the seal. In other embodiments, the swellable material comprises a swellable metallic material hardenable in response to exposure to the activation fluid. In either case, the swellable material may be of a composition and/or structure that it swells appreciably and sufficiently to form a seal with a sealing surface (e.g., the inner bore of a casing or other metal tubular) at least in the described structural arrangements disclosed herein.

A swellable rubber according to this disclosure may comprise an oil swellable rubber, such as ethylene propylene diene terpolymer (EPDM) rubber. The swellable rubber may comprise a water-swellable rubber with super absorbent additives (SAP) that will swell in water. The swellable rubber may comprise a thermal swelling elastomer that uses thermal expansion from a temperature change in order to change size, such as rubber that has been compounded with paraffin wax, which will expand when the wax melts. The swellable rubber may include reinforcing material, such as fibers longitudinally aligned so as not to interfere with swelling but to provide stiffening.

The swellable rubber may be created from a swelling part and a non-swelling part by an adhesive or by in-mold bonding, or by another similar technique. A sealing element may thus comprise a non-swelling rubber including examples such as Nitrile, hydrogenated nitrile butadiene rubber (HNBR), fluro-elastomers (FKM), perfluoro-elastomers (FFKM), and/or natural rubbers. The swellable rubber may include a swellable rubber bonded to a non-swelling rubber, a water-swelling rubber bonded to an oil-swelling rubber, and/or a water-swelling rubber bonded with a water-contracting rubber.

In comparison, a swellable metallic material according to this disclosure may be capable of forming a more robust and lasting seal than elastomer-based swellable materials. For example, the swellable metallic material may work over a larger temperature range than elastomers for operation in extreme temperature limits, low temperature sealing limits, and dynamic applications such as swabbing while running. The swellable metallic material may experience less extrusion over time and may better conform to irregular shapes.

A swellable metallic material according to this disclosure include a specific class of metallic materials that may comprise metals and metal alloys and may swell by the formation of metal hydroxides. The activation fluid for swellable metallic materials may comprise a brine. The swelling may be caused at least in part by the swellable metallic materials undergoing metal hydration reactions in the presence of brines or other activation fluid to form metal hydroxides.

The sealing element with swellable metallic material may be placed in proximity to a selected flow path and then activated after the travel joint 40 has been retracted. Activation may cause, induce, or otherwise participate in the reaction that causes the material to expand to seal an annulus of a wellbore. Activation may cause the swellable metallic material to increase its volume, become displaced, solidify, thicken, harden, or a combination thereof. The swellable metallic materials may swell in high-salinity and/or high-temperature environments where elastomeric materials, such as rubber, can perform poorly.

In one or more embodiments, the metal hydroxide occupies more space than the base metal reactant. This expansion in volume allows the swellable metallic material to swell. For example, a mole of magnesium has a molar mass of 24 g/mol and a density of 1.74 g/cm3 which results in a volume of 13.8 cm/mol. Magnesium hydroxide has a molar mass of 60 g/mol and a density of 2.34 g/cm3 which results in a volume of 25.6 cm/mol. 25.6 cm/mol is 85% more volume than 13.8 cm/mol. As another example, a mole of calcium has a molar mass of 40 g/mol and a density of 1.54 g/cm3 which results in a volume of 26.0 cm/mol. Calcium hydroxide has a molar mass of 76 g/mol and a density of 2.21 g/cm3 which results in a volume of 34.4 cm/mol. 34.4 cm/mol is 32% more volume than 26.0 cm/mol. As yet another example, a mole of aluminum has a molar mass of 27 g/mol and a density of 2.7 g/cm3 which results in a volume of 10.0 cm/mol. Aluminum hydroxide has a molar mass of 63 g/mol and a density of 2.42 g/cm3 which results in a volume of 26 cm/mol. 26 cm/mol is 160% more volume than 10 cm/mol. The swellable metallic material comprises any metal or metal alloy that may undergo a hydration reaction to form a metal hydroxide of greater volume than the base metal or metal alloy reactant. The metal may become separate particles during the hydration reaction and these separate particles lock or bond together to form what is considered as a swellable metallic material.

Examples of suitable metals for the swellable metallic material include, but are not limited to, magnesium, calcium, aluminum, tin, zinc, beryllium, barium, manganese, or any combination thereof. Preferred metals include magnesium, calcium, and aluminum. Examples of suitable metal alloys for the swellable metallic material include, but are not limited to, any alloys of magnesium, calcium, aluminum, tin, zinc, beryllium, barium, manganese, or any combination thereof. Preferred metal alloys include alloys of magnesium-zinc, magnesium-aluminum, calcium-magnesium, or aluminum-copper.

In some examples, the metal alloys may comprise alloyed elements that are not metallic. Examples of these nonmetallic elements include, but are not limited to, graphite, carbon, silicon, boron nitride, and the like. In some examples, the metal is alloyed to increase reactivity and/or to control the formation of oxides.

In some examples, the metal alloy is also alloyed with a dopant metal that promotes corrosion or inhibits passivation and thus increased hydroxide formation. Examples of dopant metals include, but are not limited to nickel, iron, copper, carbon, titanium, gallium, mercury, cobalt, iridium, gold, palladium, or any combination thereof. In examples where the swellable metallic material comprises a metal alloy, the metal alloy may be produced from a solid solution process or a powder metallurgical process. The sealing element comprising the metal alloy may be formed either from the metal alloy production process or through subsequent processing of the metal alloy. As used herein, the term "solid solution" may include an alloy that is formed from a single melt where all of the components in the alloy (e.g., a magnesium alloy) are melted together in a casting. The casting can be subsequently extruded, wrought, hipped, or worked to form the desired shape for the sealing element having the swellable metallic material. Preferably, the alloying components are uniformly distributed throughout the metal alloy, although intragranular inclusions may be present, without departing from the scope of the present disclosure.

It is to be understood that some minor variations in the distribution of the alloying particles can occur, but it is preferred that the distribution is such that a homogenous solid solution of the metal alloy is produced. A solid solution is a solid-state solution of one or more solutes in a solvent. Such a mixture is considered a solution rather than a compound when the crystal structure of the solvent remains unchanged by addition of the solutes, and when the mixture remains in a single homogeneous phase. A powder metallurgy process generally comprises obtaining or producing a fusible alloy matrix in a powdered form. The powdered fusible alloy matrix is then placed in a mold or blended with at least one other type of particle and then placed into a mold. Pressure is applied to the mold to compact the powder particles together, fusing them to form a solid material which may be used as the swellable metallic material.

In some alternative examples, the swellable metallic material comprises an oxide. As an example, calcium oxide reacts with water in an energetic reaction to produce calcium hydroxide. 1 mole of calcium oxide occupies 9.5 cm3 whereas 1 mole of calcium hydroxide occupies 34.4 cm3 which is a 260% volumetric expansion. Examples of metal oxides include oxides of any metals disclosed herein, including, but not limited to, magnesium, calcium, aluminum, iron, nickel, copper, chromium, tin, zinc, lead, beryllium, barium, gallium, indium, bismuth, titanium, manganese, cobalt, or any combination thereof.

A swellable metallic material may be selected that does not degrade into the brine. As such, the use of metals or metal alloys for the swellable metallic material that form relatively water-insoluble hydration products may be preferred. For example, magnesium hydroxide and calcium hydroxide have low solubility in water. In some examples, the metal hydration reaction may comprise an intermediate step where the metal hydroxides are small particles. The small particles have a maximum dimension less than 0.1 inch and generally have a maximum dimension less than 0.01 inches. In some embodiments, the small particles comprise between one and 100 grains (metallurgical grains).

In some alternative examples, the swellable metallic material is dispersed into a binder material. The binder may be degradable or non-degradable. In some examples, the binder may be hydrolytically degradable. The binder may be swellable or non-swellable. If the binder is swellable, the binder may be oil-swellable, water-swellable, or oil- and water-swellable. In some examples, the binder may be porous. In some alternative examples, the binder may not be porous. General examples of the binder include, but are not limited to, rubbers, plastics, and elastomers. Specific examples of the binder may include, but are not limited to, polyvinyl alcohol, polylactic acid, polyurethane, polyglycolic acid, nitrile rubber, isoprene rubber, PTFE, silicone, fluoroelastomers, ethylene-based rubber, and PEEK. In some embodiments, the dispersed swellable metallic material may be cuttings obtained from a machining process.

In some examples, the metal hydroxide formed from the swellable metallic material may be dehydrated under sufficient swelling pressure. For example, if the metal hydroxide resists movement from additional hydroxide formation, elevated pressure may be created which may dehydrate the metal hydroxide. This dehydration may result in the formation of the metal oxide from the swellable metallic material. As an example, magnesium hydroxide may be dehydrated under sufficient pressure to form magnesium oxide and water. As another example, calcium hydroxide may be dehydrated under sufficient pressure to form calcium oxide and water. As yet another example, aluminum hydroxide may be dehydrated under sufficient pressure to form aluminum oxide and water. The dehydration of the hydroxide forms of the swellable metallic material may allow the swellable metallic material to form additional metal hydroxide and continue to swell.

The use of a swellable metallic material may transform the swellable element 54 from an engineered metal alloy to a rock-like material when it react with downhole fluids, creating a long-lasting seal. This may be embodied a single piece of circular material surrounded around the inner tubing. As the downhole fluids come in contact with the expandable metallic material, the material expands and turns hard creating non-dynamic seal.

Figure 7:
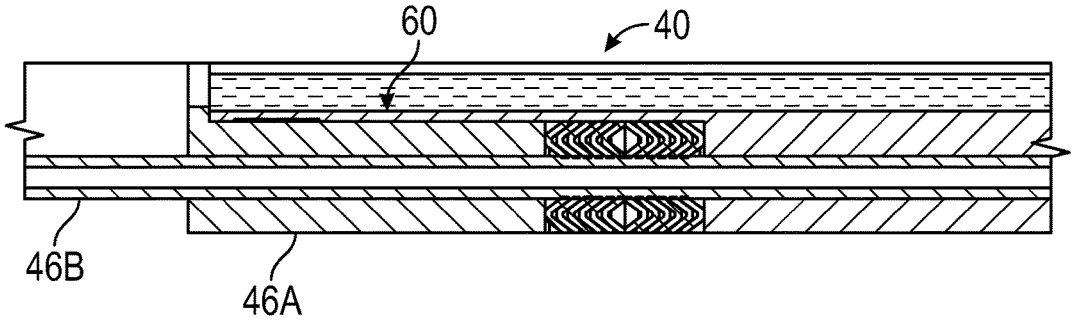
FIG. 7 is a sectional side view of the travel joint with a dynamic sealing interface between inner and outer tubes of a control line conduit.

FIG. 7 is a sectional side view of the travel joint 40 with a dynamic sealing interface 60 that maintains sealing during relative movement between the inner and outer tubes 46B, 46A. The dynamic sealing interface 60 in this example includes a seal stack 62 of V-shaped elements arranged between the inner tube 46B and outer tube 46A. This seal stack 62 will allow the expelling of the oil between the inner and outer tubes 46A, 46B.

Figure 8:
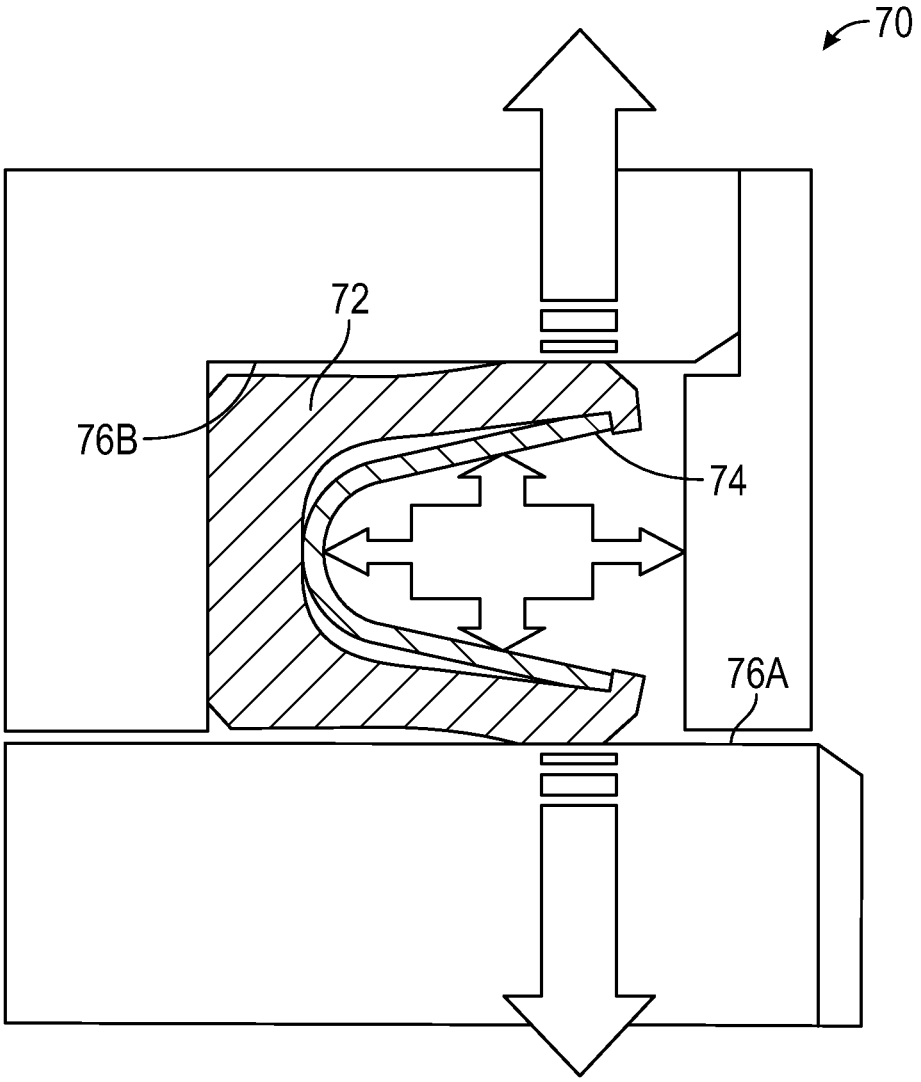
FIG. 8 is an enlarged, more detailed view of another example of the dynamic sealing interface.

FIG. 8 is an enlarged, more detailed view of another example of the dynamic sealing interface 70. A sealing element 72 with a V-shaped groove has a spring element 74 disposed therein for urging the sealing element 72 outwardly into engagement with sealing surfaces 76A, 76B.

Figure 9:
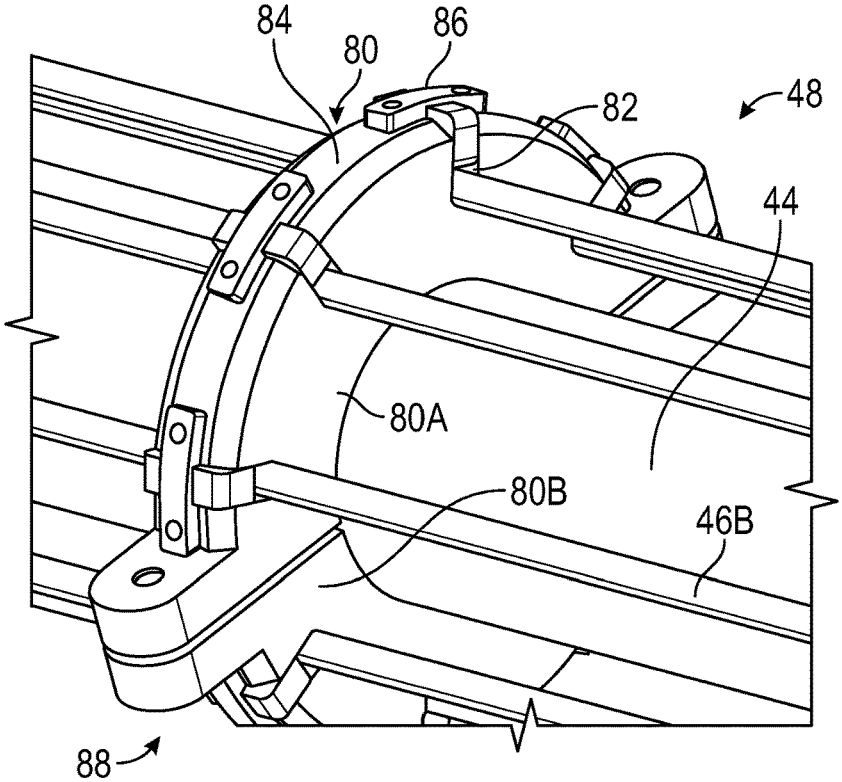
FIG. 9 is an enlarged, perspective view further detailing an example of one of the control line supports along the upper tubular member of the travel joint.

FIG. 9 is an enlarged, perspective view further detailing an example of one of the control line supports 48 along the upper tubular member 44 of the travel joint. The control line support 48 includes a collar 80 defining a plurality of circumferentially spaced apertures 82. Each inner tube 46B of the respective control line support 48 is seated within a respective one of the apertures 82. For ease of assembly, the apertures 82 may be open to a periphery 84 of the collar 80 so the inner tubes 46B may be received laterally into the respective apertures 82. Then, a retaining member 86 may be fastened to the periphery 84, using bolts or other fasteners, so as to retain the inner tubes 46B in their respective apertures 82. Sufficient clearance is provided between the inner tubes 46B and apertures 82 to allow sliding of the inner tubes 46B to accommodate axial movement in the travel joint. The collar 80, itself, may be formed of multiple collar segments, in this case, two clamp halves 80A, 80B, which may be secured about the upper tubular member 44 using a flange 88. Thus, the control line support 48 slidably supports the inner tubes 46B of the telescoping control line conduits to accommodate axial movement of the inner tubes 46B relative to the control line support 48.

Figure 10:
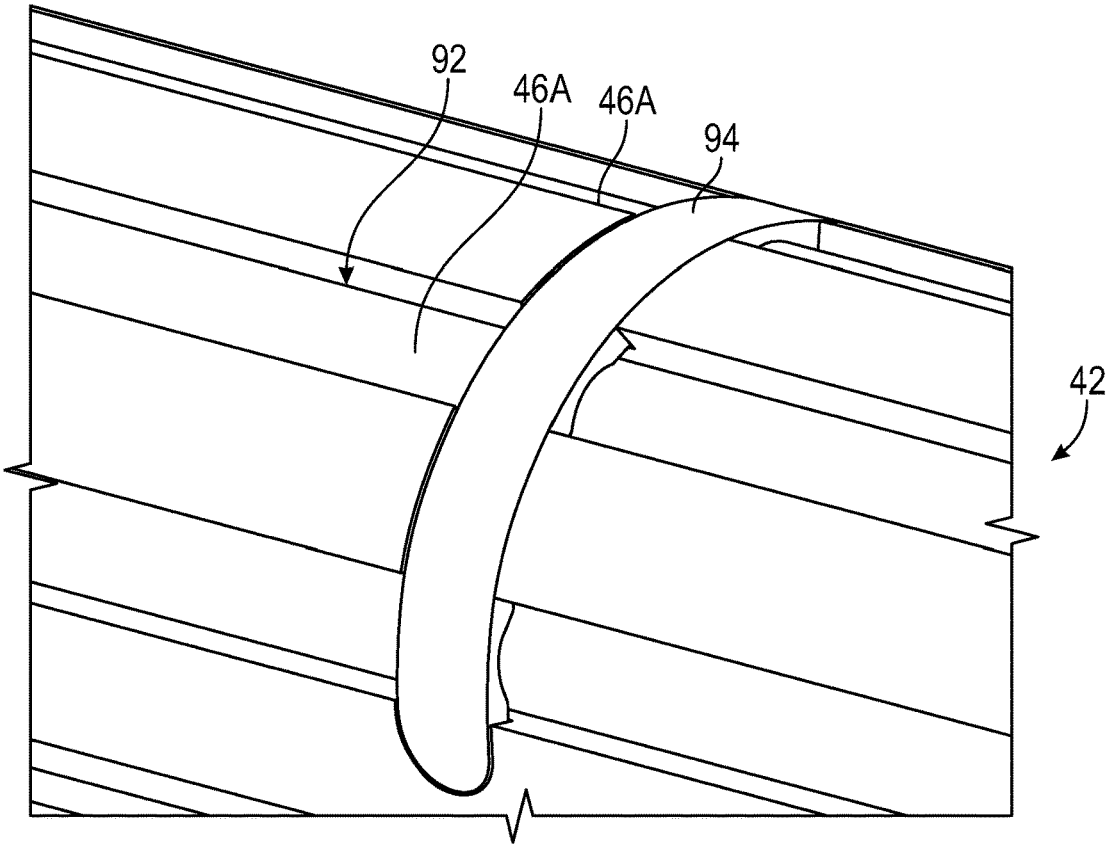
FIG. 10 is an enlarged, perspective view further detailing an example of securing the control line support outer tubes to the lower tubular member of the travel joint.

FIG. 10 is an enlarged, perspective view further detailing an example of securing the control line support outer tubes 46A to the lower tubular member 42 of the travel joint. The outer tubes 46A may be seated within channels 92 longitudinally extending and circumferentially spaced about the lower tubular member 42. The channels 92 are generally aligned with the apertures 82 on the collar 80 (referring momentarily to FIG. 9). A clamp 94 is secured about a periphery of the travel joint, capturing the outer tubes 46A in their respective channels 92.

Thus, aspects of the disclosure may be incorporated into a well system including an upper completion for retrievably lowering into a well toward a lower completion. The upper completion comprises production tubing for conveying well fluids from the lower completion and one or more control signal paths for communicating with one or more components of the lower completion. A travel joint coupled to a lower end of the upper completion may include an upper tubular member telescopically coupled to a lower tubular member to collectively define a flow path for the well fluids through the travel joint. A plurality of telescoping control line conduits are secured about the travel joint, each including an outer tube telescopically coupled to an inner tube to accommodate relative movement between the upper and lower tubular members. A control line may thus be routed through each telescoping tube set in communication with a respective one of the control signal paths. A disconnect tool coupled to the lower tubular member of the travel joint for releasably, sealingly connecting to the lower completion. When connected to the lower completion, the travel joint allows communication of well fluids and control signals between the upper and lower completions via the telescoping travel joint.

Aspects of the disclosure may also be incorporated into a method of operating a well. In an example, such a method may broadly entail lowering an upper completion into the well with a travel joint coupled to a lower end of the upper completion. The travel joint may include an upper tubular member telescopically coupled to a lower tubular member. The method may further include using a disconnect tool to releasably, sealing connecting the lower tubular member of the travel joint to the lower completion to define a fluid pathway extending from the upper completion to the lower completion through the travel joint. The upper completion may be further lowered to telescopically retract the upper tubular member with respect to the lower tubular member of the travel joint. Simultaneously relative movement between upper and lower tubular members may be accommodated with a telescoping control line conduit having a control line routed therethrough. Well fluids may thus be produced through the travel joint and control signals may be transmitted through the travel joint.

The various apparatus, systems, methods, and so forth may include any of the various features disclosed herein, including one or more of the following examples.

Example 1. A travel joint, comprising: a lower tubular member; an upper tubular member telescopically coupled to the lower tubular member to collectively define a flow path for well fluids through the travel joint; a plurality of telescoping control line conduits secured about a travel joint periphery, each telescoping control line conduit including an outer tube telescopically coupled to an inner tube to accommodate relative movement between the upper and lower tubular members; and a control line routed through each telescoping control line conduit.

Example 2. The travel joint of Example 1, wherein the lower tubular member comprises a disconnect tool for releasably, sealingly connecting to a lower completion of a well.

Example 3. The travel joint of Examples 1 or 2, further comprising: a seal disposed within each telescoping control line conduit to seal between the inner tube and the outer tube.

Example 4. The travel joint of Example 3, wherein the seal comprises a dynamic seal that maintains sealing during relative movement between the inner tube and the outer tube.

Example 5. The travel joint of Example 4, wherein the dynamic seal comprises a stack of V-shaped sealing elements.

Example 6. The travel joint of Examples 3 or 4, wherein the seal comprises a swellable material that swells in response to exposure to an activation fluid [after securing the lower tubular member to the lower completion].

Example 7. The travel joint of Example 6, wherein the swellable material comprises a swellable metallic material hardenable in response to exposure to the activation fluid.

Example 8. The travel joint of Examples 1 to 6, wherein the one or more control lines comprise an electrical control line for communicating electrical signals to one or more downhole components, an optical control line for communicating optical signals to the one or more downhole components, and/or a hydraulic control line for communicating hydraulic pressure for hydraulically actuating the one or more downhole components.

Example 9. The travel joint of Examples 1 to 8, wherein the control line comprises an electrical signal transmission path with a sliding electrical contact for accommodating relative movement between the inner tube and the outer tube of the control line conduits.

Example 10. The travel joint of Examples 1 to 9, further comprising: one or more control line supports coupled to the upper tubular member and/or the lower tubular member that support the telescoping control line conduits circumferentially about the upper tubular member and the lower tubular member.

Example 11. The travel joint of Example 10, wherein the one or more control line supports slidably support the inner tubes of the telescoping control line conduits to accommodate axial movement of the inner tubes relative to the control line supports.

Example 12. A well system, comprising: an upper completion for retrievably lowering into a well toward a lower completion installed in the well, the upper completion comprising production tubing for conveying well fluids from the lower completion and one or more control signal paths for communicating with one or more components of the lower completion; a travel joint coupled to a lower end of the upper completion and including an upper tubular member telescopically coupled to a lower tubular member to collectively define a flow path for the well fluids through the travel joint, a plurality of telescoping control line conduits secured about the travel joint, each including an outer tube telescopically coupled to an inner tube to accommodate relative movement between the upper and lower tubular members, and a control line routed through each telescoping control line conduit and in communication with a respective one of the control signal paths; and a disconnect tool coupled to the lower tubular member of the travel joint for releasably, sealingly connecting to the lower completion.

Example 13. The well system of Example 12, further comprising: a seal disposed within each telescoping control line conduit to seal between the inner tube and the outer tube.

Example 14. The travel joint of Example 13, wherein the seal comprises a dynamic seal that maintains sealing during relative movement between the inner tube and the outer tube.

Example 15. The well system of Examples 13 or 14, wherein the seal comprises a swellable material that swells in response to exposure to an activation fluid.

Example 16. The well system of Example 15, wherein the swellable material comprises a swellable metallic material hardenable in response to exposure to the activation fluid.

Example 17. The well system of Examples 12 to 15, wherein the one or more control lines comprise an electrical control line for communicating electrical signals to one or more downhole components, an optical control line for communicating optical signals to the one or more downhole components, and/or a hydraulic control line for communicating hydraulic pressure for hydraulically actuating the one or more downhole components.

Example 18. The well system of Examples 12 to 17, further comprising: one or more control line supports coupled to the upper tubular member and/or lower tubular member that support the telescoping control line conduits circumferentially about the upper and lower tubular members, wherein the one or more control line supports slidably support the inner tubes of the telescoping control line conduits to accommodate axial movement of the inner tubes relative to the control line supports.

Example 19. A method, comprising: lowering an upper completion into a well with a travel joint coupled to a lower end of the upper completion, the travel joint including an upper tubular member telescopically coupled to a lower tubular member; using a disconnect tool to releasably, sealing connecting the lower tubular member of the travel joint to the lower completion to define a fluid pathway extending from the upper completion to the lower completion through the travel joint; and lowering the upper completion to telescopically retract the upper tubular member with respect to the lower tubular member of the travel joint while accommodating relative movement between upper and lower tubular members of a telescoping control line conduit having a control line routed therethrough.

Example 20. The method of Example 19, further comprising: conveying well fluids along the fluid pathway through the travel joint; and communicating control signals along one or more control signal paths between the upper completion and the lower completion through the telescoping control line conduits.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A travel joint, comprising:

a lower tubular member;

an upper tubular member telescopically coupled to the lower tubular member to collectively define a flow path for well fluids through the travel joint;

a plurality of telescoping control line conduits secured about a travel joint periphery, each telescoping control line conduit including an outer tube telescopically coupled to an inner tube to accommodate relative movement between the upper and lower tubular members; and a control line routed through each telescoping control line conduit.

2. The travel joint of claim 1, wherein the lower tubular member comprises a disconnect tool for releasably, sealingly connecting to a lower completion of a well.

3. The travel joint of claim 1, further comprising:

a seal disposed within each telescoping control line conduit to seal between the inner tube and the outer tube.

4. The travel joint of claim 3, wherein the seal comprises a dynamic seal that maintains sealing during relative movement between the inner tube and the outer tube.

5. The travel joint of claim 4, wherein the dynamic seal comprises a stack of V-shaped sealing elements.

6. The travel joint of claim 3, wherein the seal comprises a swellable material that swells in response to exposure to an activation fluid.

7. The travel joint of claim 6, wherein the swellable material comprises a swellable metallic material hardenable in response to exposure to the activation fluid.

8. The travel joint of claim 1, wherein the one or more control lines comprise an electrical control line for communicating electrical signals to one or more downhole components, an optical control line for communicating optical signals to the one or more downhole components, and/or a hydraulic control line for communicating hydraulic pressure for hydraulically actuating the one or more downhole components.

9. The travel joint of claim 1, wherein the control line comprises an electrical signal transmission path with a sliding electrical contact for accommodating relative movement between the inner tube and the outer tube of the control line conduits.

10. The travel joint of claim 1, further comprising:

one or more control line supports coupled to the upper tubular member and/or the lower tubular member that support the telescoping control line conduits circumferentially about the upper tubular member and the lower tubular member.

11. The travel joint of claim 10, wherein the one or more control line supports slidably support the inner tubes of the telescoping control line conduits to accommodate axial movement of the inner tubes relative to the control line supports.

12. A well system, comprising:

an upper completion for retrievably lowering into a well toward a lower completion installed in the well, the upper completion comprising production tubing for conveying well fluids from the lower completion and one or more control signal paths for communicating with one or more components of the lower completion;

a travel joint coupled to a lower end of the upper completion and including an upper tubular member telescopically coupled to a lower tubular member to collectively define a flow path for the well fluids through the travel joint, a plurality of telescoping control line conduits secured about the travel joint, each including an outer tube telescopically coupled to an inner tube to accommodate relative movement between the upper and lower tubular members, and a control line routed through each telescoping control line conduit and in communication with a respective one of the control signal paths; and a disconnect tool coupled to the lower tubular member of the travel joint for releasably, sealingly connecting to the lower completion.

13. The well system of claim 12, further comprising:

a seal disposed within each telescoping control line conduit to seal between the inner tube and the outer tube.

14. The travel joint of claim 13, wherein the seal comprises a dynamic seal that maintains sealing during relative movement between the inner tube and the outer tube.

15. The well system of claim 13, wherein the seal comprises a swellable material that swells in response to exposure to an activation fluid.

16. The well system of claim 15, wherein the swellable material comprises a swellable metallic material hardenable in response to exposure to the activation fluid.

17. The well system of claim 12, wherein the one or more control lines comprise an electrical control line for communicating electrical signals to one or more downhole components, an optical control line for communicating optical signals to the one or more downhole components, and/or a hydraulic control line for communicating hydraulic pressure for hydraulically actuating the one or more downhole components.

18. The well system of claim 12, further comprising:

one or more control line supports coupled to the upper tubular member and/or lower tubular member that support the telescoping control line conduits circumferentially about the upper and lower tubular members, wherein the one or more control line supports slidably support the inner tubes of the telescoping control line conduits to accommodate axial movement of the inner tubes relative to the control line supports.

19. A method, comprising:

lowering an upper completion into a well with a travel joint coupled to a lower end of the upper completion, the travel joint including an upper tubular member telescopically coupled to a lower tubular member;

using a disconnect tool to releasably, sealing connecting the lower tubular member of the travel joint to the lower completion to define a fluid pathway extending from the upper completion to the lower completion through the travel joint; and lowering the upper completion to telescopically retract the upper tubular member with respect to the lower tubular member of the travel joint while accommodating relative movement between upper and lower tubular members of a telescoping control line conduit having a control line routed therethrough.

20. The method of claim 19, further comprising:

conveying well fluids along the fluid pathway through the travel joint; and communicating control signals along one or more control signal paths between the upper completion and the lower completion through the telescoping control line conduits.

* * * * *